United States Patent [19]

Yoneyama et al.

[11] Patent Number: 4,623,614

[45] Date of Patent: Nov. 18, 1986

[54] SILVER HALIDE PHOTOGRAPHIC LIGHT-SENSITIVE MATERIALS

[75] Inventors: Masakazu Yoneyama; Yukio Maekawa; Shigeki Yokoyama; Junichi Yamanouchi, all of Kanagawa, Japan

[73] Assignee: Fuji Photo Film Co., Ltd., Kanagawa, Japan

[21] Appl. No.: 763,111

[22] Filed: Aug. 7, 1985

[30] Foreign Application Priority Data

Aug. 7, 1984 [JP] Japan ..... 59-165081

[51] Int. Cl.[4] ..... G03C 1/84

[52] U.S. Cl. ..... 430/523; 430/527; 430/950; 430/961

[58] Field of Search ..... 430/523, 961, 950, 527

[56] References Cited

U.S. PATENT DOCUMENTS

| | | | |
|---|---|---|---|
| 4,004,927 | 1/1977 | Yamamoto et al. | 430/961 |
| 4,047,958 | 9/1977 | Yoneyama et al. | 430/531 |
| 4,190,449 | 2/1980 | Naio | 430/961 |
| 4,404,276 | 9/1983 | Steklenski | 430/961 |

*Primary Examiner*—Jack P. Brammer

*Attorney, Agent, or Firm*—Sughrue, Mion, Zinn, Macpeak & Seas

[57] ABSTRACT

A silver halide photographic light-sensitive material is described, comprising a support having thereon at least one silver halide photographic light-sensitive emulsion layer, said photographic light-sensitive material further comprising at least one light-insensitive surface layer on at least one side thereof, at least one of said surface layer or layers comprising a graft polymer or copolymer having a silicone unit, and at least one of said surface layer or layers and a layer or layers adjacent to the surface layer or layers comprising an antistatic agent.

The silver halide light-sensitive material has good antistatic property and reduced sliding friction without giving bad influences on the photographic properties; has good antistatic property and lubricity after development processing; has improved antistatic property and lubricity without reducing the coating properties at the production of the photographic light-sensitive material; and forms no scum during development processing.

6 Claims, No Drawings

SILVER HALIDE PHOTOGRAPHIC LIGHT-SENSITIVE MATERIALS

FIELD OF THE INVENTION

This invention relates to a silver halide photographic light-sensitive material having improved physical properties and, more particularly, to a photographic light-sensitive material simultaneously having both an improved antistatic property and improved lubricity without giving any bad influences on the coating property at the production of the photographic light-sensitive material by the existence of a graft polymer or copolymer comprising a silicone unit in at least one layer of the surface layers of the photographic light-sensitive material and also the existence of an antistatic agent in the surface layer or layers or a layer or layers adjacent to the surface layer or layers.

BACKGROUND OF THE INVENTION

A photographic light-sensitive material is generally composed of a support such as a glass plate, a paper, a plastic film, or a plastic-coated paper having coated thereon light-sensitive photographic emulsion layers and, if necessary, layers for constituting the photographic light-sensitive material, such as interlayers, a protective layer, a back layer, an antihalation layer, an antistatic layer, etc. A photographic light-sensitive material is frequently accompanied by undesirable influences by the contact friction occurring at the contact portions of the photographic light-sensitive material with various devices, machines, cameras, etc., in the production steps thereof such as coating, drying, working, etc., or in the treatment such as winding, rewinding, or transporting of a photographic light-sensitive material in the case of photographing, developing, printing or projecting, or the contact friction between the photographic light-sensitive material and dust, fiber waste, etc., attached to the photographic light-sensitive material, or further the contact friction between the surface and the back side of the photographic light-sensitive materials themselves. For example, there are the occurrence of troubles by the accumulation of electrostatic charges, the formation of scratches or abrasions on the surface of a photographic light-sensitive material at the emulsion layer side or the back side, the reduction in the driving property of a photographic light-sensitive material in camera or other devices, and the formation of film waste in camera or other devices.

The most serious problem in the troubles caused by the accumulation of electrostatic charges is that the accumulated electrostatic charges in a photographic light-sensitive material are discharged before processing the photographic light-sensitive material and the light-sensitive emulsion layers are exposed to light caused by the discharge, whereby the exposed portions cause spot-like stains or twig-like or feather-like stains after developing the photographic light-sensitive material. This is so-called static mark, which greatly reduces or, as the case may be, completely lose the commercial value of the photographic light-sensitive material. The phenomenon is very troublesome problem since the occurrence of the phenomenon cannot be confirmed before development. Also, the electrostatic charges accumulated on the surface of a photographic light-sensitive material or a support film for a photographic light-sensitive material cause a secondary trouble that a dust is liable to attach onto the surface thereof or a coating solution cannot be uniformly coated on the support film.

Furthermore, the attenment of dust on the surface of a photographic film causes a serious problem after development, particularly, in the case of negative film.

That is, it will be easily understood that when the images of the negative film are printed on a positive film or a photographic paper, the existence of dust on the surface of the negative film causes a serious trouble for the formation of the print inages.

One of the methods of removing the troubles caused by electrostatic charges is to release the electrostatic charges in a short period of time before the charges are discharged in the photographic light-sensitive material by increasing the electric conductivity of the surface of the photographic light-sensitive material.

Accordingly, as a method of increasing the conductivity of the support of a photographic light-sensitive material or various coated surface layers, it has hitherto been attempted to utilize various hygroscopic materials or water-soluble inorganic salts, certain kinds of surface active agents or polymers. For example, there are polymers described in, for example, U.S. Pat. Nos. 2,882,157, 2,972,535, 3,062,785, 3,262,807, 3,514,291, 3,615,531, 3,753,716, 3,938,999, etc., surface active agents described in, for example, U.S. Pat. Nos. 2,982,651, 3,428,456, 3,457,076, 3,454,625, 3,552,972, 3,655,387, etc., and metal oxides, colloid silica, etc., described in, for example, U.S. Pat. Nos. 3,062,700, 3,245,833, 3,525,621, etc.

On the other hand, various methods of obtaining photographic light-sensitive materials having an improved physical property that the photographic light-sensitive material can freely move through film magazines, camera gates such as movie camera gates, projector gates, etc., and printing machine gates without damaging layers for constituting the photographic light-sensitive material by increasing the abrasion resistance of the layers for constituting the photographic light-sensitive material or reducing sliding friction of the photographic light-sensitive material have hitherto been proposed. For example, there are known a method of imparting lubricity to a photographic film by incorporating dimethyl silicone and a specific surface active agent in the photographic silver halide emulsion layer or layers or the protective layer of the photographic film as described in U.S. Pat. No. 3,042,522, a method of imparting lubricity to a photographic film by coating a mixture of dimethyl silicone and diphenyl silicone on the back surface of the photographic film support as described in U.S. Pat. No. 3,080,317, a method of imparting lubricity to a photographic film by incorporating methylphenyl silicone having a triphenyl terminal in the protective layer of the photographic film as described in British Patent No. 1,143,118, and a method of imparting lubricity and sticking resistance to a photographic light-sensitive material by incorporating a dilower alkyl silicone and $\beta$-alanine series surface active agent as described in U.S. Pat. No. 3,489,567.

Also, for overcoming the above described difficulty, there are a method of using a liquid organo polysiloxane having an alkyl group having 5 or more carbon atoms as described in Japanese Patent Publication No. 292/78 (corresponding to British Patent No. 1,483,673), a method of using an alkyl polysiloxane having a polyoxyalkylene chain as described in U.S. Pat. No.

4,047,958, and a method of using a cross-linking silicone as described in U.S. Pat. No. 4,404,276.

For improving the performance of a photographic light-sensitive material, it is required to simultaneously improve the antistatic property and lubricity (scratch resistance) of the photographic light-sensitive material but the attempt of improving the antistatic property and physical property of a photographic light-sensitive material by using the above described known method encounters the following disadvantages.

That is, there are disadvantages such as bad influences on the coating aptitude at the production of a photographic light-sensitive material, the formation of scum in processing solutions, the occurrence of attaching substances on rollers, the reduction in antistatic faculty after processing, and the reduction in lubricity. The reduction in coating aptitude is in the formation of uneven coating at the case of coating, for example, silicone on the back surface of a support of a photographic light-sensitive material and coating silver halide photographic emulsions on the opposite surface of the back surface, and also the formation of scum is closely related with a surface active agent such as a coating aid and an emulsifier used, which causes serious film troubles such as uneven coating, etc. Also, the reduction in antistatic faculty causes attachments of dust on the surface of a photographic light-sensitive material and, in particular, in the case of a negative photographic film, the attachment of dust gives serious problems for the formation of images at printing onto photographic papers.

SUMMARY OF THE INVENTION

A first object of this invention is to provide a photographic light-sensitive material having a good antistatic property and reduced sliding friction without giving bad influences on the photographic properties (such as sensitivity, fog, etc.).

A second object of this invention is to provide a photographic light-sensitive material having a good antistatic property and lubricity after development processing.

A third object of this invention is to provide a photographic light-sensitive material having an improved antistatic property and lubricity without reducing the coating properties at the production of the photographic light-sensitive material.

A fourth object of this invention is to provide a photographic light-sensitive material forming no scum during development processing.

As a result of various investigations on considering the features of graft polymers or copolymers, the inventors have discovered that the above described objects of this invention have been attained by a silver halide photographic light-sensitive material comprising a support having thereon at least one silver halide photographic light-sensitive emulsion layer, said silver halide photographic light-sensitive material further comprising at least one light-insensitive surface layer on at least one side thereof, at least one of said surface layer or layers comprising a graft polymer or copolymer having a silicone unit, and at least one of said surface layer or layers and a layer or layers adjacent to the surface layer or layers comprising an antistatic agent.

DETAILED DESCRIPTION OF THE INVENTION

The application of the silicone graft polymer or copolymer for use in this invention for photographic light-sensitive materials has not yet been utterly shown and it has first been discovered by the inventors that the silicone graft polymer or copolymer is remarkably effective as lubricity for photographic light-sensitive materials.

That is, the use of the silicone graft polymer or copolymer in this invention can impart lubricity (scratch resistance) to photographic light-sensitive materials, even if it is in a small amount, without causing troubles at coating silver halide photographic emulsions and without reducing the performance of an antistatic agent together with the silicone graft polymer or copolymer. Also, the use of the silicone graft polymer or copolymer in this invention can decrease the formation of scum in the processing solution and the deterioration of the antistatic property and the lubricity.

The improvement of the antistatic property and lubricity (scratch resistance) of a photographic light-sensitive material by the combination of the silicone graft polymer or copolymer and the antistatic agent is based on the fact that the graft copolymer comprising a component having a silicone group and a component showing an affinity with a polymer (e.g., a hydrophilic polymer such as gelatin or a hydrophobic polymer such as cellulose acetate, polyethyl methacrylate, etc., hereinafter, there are referred to as a photographic polymer) used as a binder for layers for constituting the photographic light-sensitive material, said graft copolymer having water repellency and surface orienting property as well as having the effect of improving the lubricity and scratch resistance of the surface of the photographic light-sensitive material is advantageous different from the conventional method of using an ordinary silicone oligomer. Also, as a matter of course, the performance of the silicone graft polymer or copolymer changes in accordance with the structures of the silicone and component having an affinity with a photographic polymer as binder.

The feature of this invention is in the existence of a small amount of a polymer or copolymer obtained by grafting water repellent silicone having less affinity with a photographic polymer to a component having an affinity with the photographic polymer as a trunk polymer (or a polymer or copolymer obtained by grafting the component having an affnitity with a photographic polymer to water repellent silicone having less affinity with the photographic polymer) in the surface layer or layers of a photographic light-sensitive material and the existence of an antistatic agent in the same surface layer or layers or a layer or layers adjacent to the surface layer or layers.

The graft copolymer composition for use in this invention is useful as a coating for a photographic light-sensitive material and, in particular, forms a back layer on a support of a photographic light-sensitive material.

The photographic light-sensitive material of this invention is imparted with an excellent antistatic property and lubricity (scratch resistance) and since the silicone graft polymer or copolymer for use in this invention is reluctant to easily separate from the surface of the coated layer by the existence of the component having an affinity with a photographic polymer, the invention also has such features that the problems occurring by the transfer of silicone in the case of coating silver halide photographic emulsions can be solved, the formation of scum in processing solutions at processing can be prevented, and the reduction in the antistatic property and lubricity of the photographic light-sensitive material, can be prevented.

A preferred example of silicone unit as a graft component of the silicone graft polymer or copolymer for use in this invention is shown by the following general formula (I):

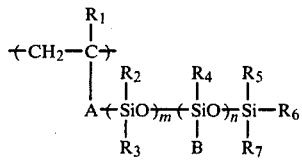

(I)

wherein $R_1$ represents a hydrogen atom or a methyl group; $R_2$, $R_3$, $R_4$, $R_5$, $R_6$ and $R_7$, which may be the same or different, each represents an alkyl group (e.g., a methyl group, an ethyl group, a propyl group, a dodecyl group, etc.), a substituted alkyl group (e.g., an alkoxyalkyl group, an arylalkyl group, etc.), an aryl group (e.g., a phenyl group, etc.), a substituted aryl group (e.g., a tolyl group, etc.) or a cycloalkyl group (e.g., a cyclohexyl group, etc.), each having 1 to 20 carbon atoms and is preferably a methyl group; m represents 0 or an integer of 1 to 400, preferably 10 to 200; n represents 0 or an integer of 1 to 50, preferably 1 to 20 and $m+n=0$ to 450; when m and n are 0, said $R_5$, $R_6$ and $R_7$ each represents

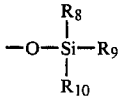

(wherein $R_8$, $R_9$ and $R_{10}$ have the same significance as those shown by $R_2$, $R_3$ and $R_4$ described above); A represents a divalent group such as

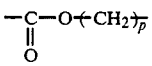

(wherein p represents an integer of 2 to 10),

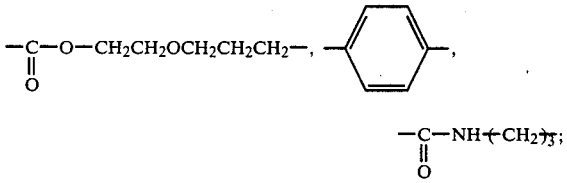

and B represents a substituted alkyl group having a reactive group such as an alcohol group, an amine group, a carboxy group, a mercapto group, a halogen atom, an epoxy group, etc. (e.g., $-CH_2)_3(CH_2CH_2O)_qR$ (wherein R represents a hydrogen atom or an alkyl group and q represents an integer of 1 to 100), $\text{-}(CH_2)_3\text{-}NH_2$, $\text{-}(CH_2)_3\text{-}NHCH_2CH_2\text{-}NH_2$, $\text{-}(CH_2)_3\text{-}COOH$, -continued or $\text{-}(CH_2)_3\text{-}CH_2\text{-}CH\text{-}CH_2)$.

On the other hand, the comonomer for the silicone graft copolymers for use in this invention includes all the monomers derived from copolymerizable monomers having an ethylenically unsaturated group.

Also, the trunk polymer includes all vinylic polymers, condensed series polymers, etc., and it is important that the trunk polymer has an affinity with a photographic polymer or binder which is used for the photographic light-sensitive material.

Examples of the comonomer are acrylic acid, methacrylic acid, alkyl esters of the acids (e.g., methyl methacrylate, ethyl acrylate, hydroxyethyl acrylate, propyl acrylate, cyclohexyl acrylate, 2-ethylhexyl acrylate, dodecyl acrylate, β-cyanoethyl acrylate, β-chloroethyl acrylate, 2-ethoxyethyl acrylate, sulfopropyl methacrylate, etc.), vinyl esters (e.g., vinyl acetate, vinyl propionate, vinyl butyrate, etc.), vinyl ethers (e.g., methyl vinyl ether, butyl vinyl ether, oleyl vinyl ether, etc.), vinyl ketones (e.g., methyl vinyl ketone, ethyl vinyl ketone, etc.), styrenes (e.g., styrene, methylstyrene, dimethylstyrene, 2,4,6-trimethylstyrene, ethylstyrene, laurylstyrene, chlorostyrene, methoxystyrene, cyanostyrene, chloromethylstyrene, vinylbenzoic acid, styrenesulfonic acid, α-methylstyrene, etc.), vinylheterocyclic compounds (e.g., vinylpyridine, vinylpyrrolidone, vinylimidazole, etc.), acrylonitrile, vinyl chloride, vinylidene chloride, vinylidene fluoride, ethylene, propylene, butadiene, diisobutylene, isoprene, chloroprene, tetrafluoroethylene, etc.

The copolymer for use in this invention is not limited to the above described copolymerizable monomers but any comonomers having the structural unit shown by the above described general formula can be used in this invention.

These comonomers can be used solely or as a combination of two or more comonomers.

The kind and molecular weight of the graft component silicone shown by general formula (I) described above and the kind and ratio of the copolymerizable monomer (or the trunk polymer) for use in this invention can be selected in wide ranges according to the compositions of the layers for constituting the silver halide photographic light-sensitive materials of this invention to which the graft copolymer is applied as a lubricant or scratch resisting agent.

That is, the kind and the copolymerization ratio of the copolymerizable ethylenic monomer derived from silicone and the comonomer as well as the ratio of silicone introduced in the trunk polymer in the case of combining the reactive silicone to the trunk polymer and the kinds of the polymer can be desirably selected according to the purposes (i.e., improvement in scratch resistance and sliding property) and the graft polymer formed may take various forms such as an oily form, a jelly form, a solid form, etc., according to the selection thereof.

Then, specific examples of the graft polymer or copolymer having a silicone unit for use in this invention are illustrated below.

(1)

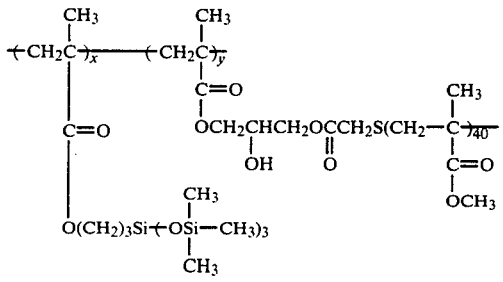

x:y = 92:8

(2)

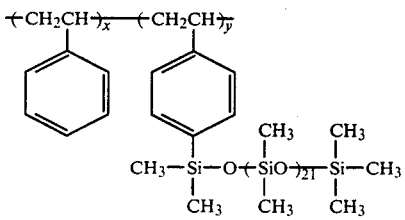

x:y = 90:10

(3)

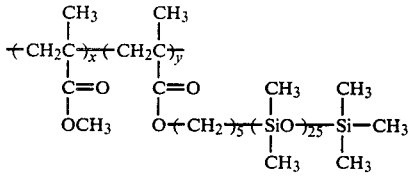

x:y = 96:4

(4)

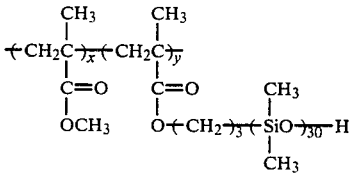

x:y = 99:1

(5)

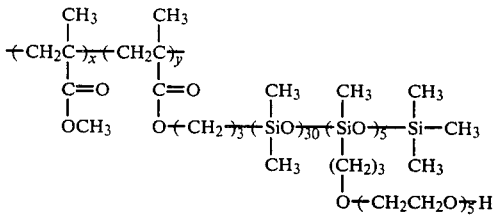

x:y = 95:5

(6)

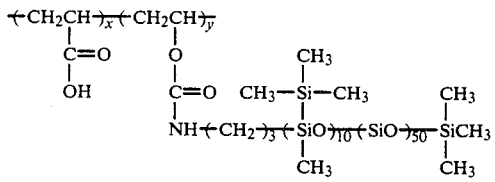

x:y = 90:10

(7)

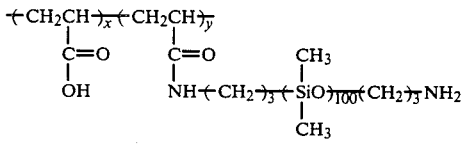

x:y = 99.5:0.5

-continued (8)

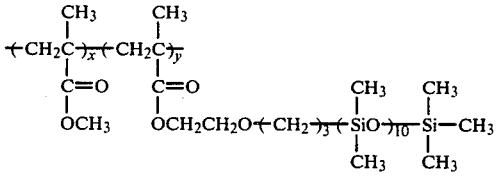

x:y = 85:15

(9)

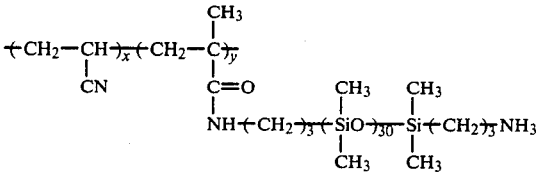

x:y = 95:5

(10)

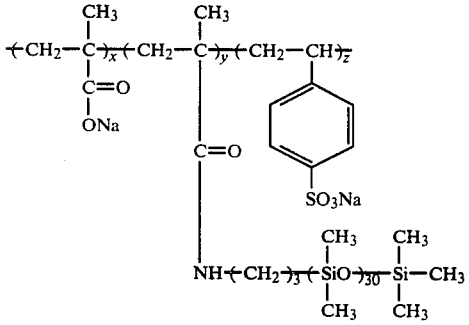

x:y:z = 45:10:45

(11)

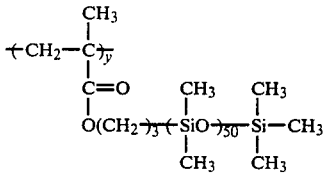

(12)

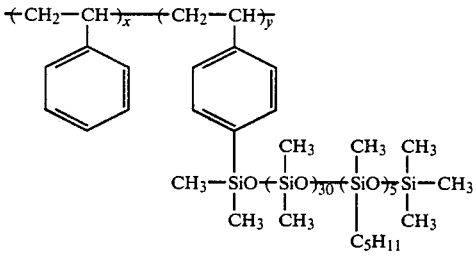

x:y = 98:2

The silicone graft polymers or copolymers for use in this invention can be prepared by known methods, such as a grafting method using radiation, light, plasma, etc., and a method of combining reactive silicone and a trunk polymer but a method of using a macromonomer of silicone, which was developed recently, is preferred since in this case a graft polymer is definitely obtained with less by-production of homopolymer, etc.

Examples of the method are described in *Polymer J,* 14, (11), 913 (1982), *Yukagaku Toron Kai Yoshi Shu,* C10, 107 (1958), *Macromolecules,* 3, 458 (1970), *Makromol. Chem.,* 185, 9–18 (1984), Yamashita et al., *Yukagaku,* 29, (4), 219 (1980), Japanese Patent Application (OPI) Nos. 167606/83, 152022/83 (the term "OPI" as used herein refers to a "published unexamined Japanese patent application"), etc.

The copolymerization of the silicone macromonomer and the comonomer can be performed by a conventional method. For example, the copolymerization can be easily performed using a radical polymerization initiator. Examples of a method of grafting reactive silicone to the polymer are described in, for example, Japanese Patent Publication No. 9355/71, Japanese Patent Application (OPI) No. 135391/77 (corresponding to West German Patent No. 2,613,646), etc.

Also, some of these silicone graft copolymers are recently commercially available by, for example, Toagosei Chemical Industry Co., Ltd.

As the antistatic agent for use in this invention, various compounds which are usually used as antistatic agents for silver halide photographic light-sensitive materials can be used.

For example, specific examples of the antistatic agents are described in *Research Disclosure,* Vol. 176, Paragraph XIII of Item 17643.

Furthermore, there are the hydrophilic polymers as described in, for example, U.S. Pat. Nos. 2,725,297, 2,972,535, 2,972,536, 2,972,537, 2,972,538, 3,033,679, 3,072,484, 3,262,807, 3,525,621, 3,615,531, 3,630,743, 3,653,906, 3,655,384, 3,655,386, British Patents No. 1,222,154, 1,235,075, etc., the hydrophobic polymers as described in, for example, U.S. Pat. Nos. 2,973,263, 2,976,148, etc., the biguanide compounds as described in, for example, U.S. Pat. Nos. 2,584,362, 2,591,590, etc., the sulfonic acid type anionic compounds as described in, for example, U.S. Pat. Nos. 2,639,234, 2,649,372; 3,201,251, 3,457,076, etc., the phosphoric acid esters and quaternary ammonium salts as described in, for example, U.S. Pat. No. 3,317,344, 3,514,291, etc., the cationic compounds as described in, for example, U.S. Pat. Nos. 2,882,157, 2,982,651, 3,399,995, 3,549,369, 3,564,043, etc., the nonionic compounds as described in, for example, U.S. Pat. No. 3,625,695, etc., the amphoteric compounds as described in, for example, U.S. Pat. No. 3,736,268. The complex compounds as described in, for example, U.S. Pat. No. 2,647,836, the organic salts as described in, for example, U.S. Pat. Nos. 2,717,834, 3,655,387, etc.

The particularly preferred antistatic agent is the polymeric compound having a monomer unit represented by the following general formula (II) or (III):

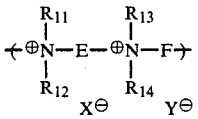

(II)

wherein $R_{11}$, $R_{12}$, $R_{13}$ and $R_{14}$ each represents a lower alkyl group having 1 to 4 carbon atoms; E and F each represents a divalent linkage group; said $R_{11}$, E and $R_{13}$ or said $R_{11}$, E and $R_{13}$ and said $R_{12}$, E and $R_{14}$ may form a ring; also, said $R_{11}$ and $R_{13}$, said $R_{12}$ and $R_{14}$, or said E and F may be the same or different; and $X^{\ominus}$ and $Y^{\ominus}$ each represents an anion such as a halogen ion, $CH_2SO_4^{\ominus}$,

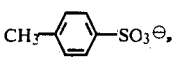

etc.;

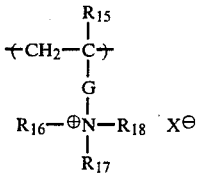

(III)

wherein $R_{15}$ represents a hydrogen atom or an alkyl group having 1 to 4 carbon atoms; G represents a divalent linkage group; $R_{16}$, $R_{17}$ and $R_{18}$ each represents an alkyl group, a substituted alkyl group, or a cycloalkyl group, each having 1 to 8 carbon atoms; said $R_{16}$ and $R_{17}$ may form a ring; $X^{\ominus}$ has the same meaning as described above.

The cationic monomer for use in this invention reacts with an optional vinyl monomer copolymerizable with the monomer and a difunctional cross-linkable monomer to form a copolymer of the cationic monomer.

Then, specific examples of the preferred antistatic agents for use in this invention are illustrated below but the antistatic agents in this invention are not limited to these materials.

A-(1)

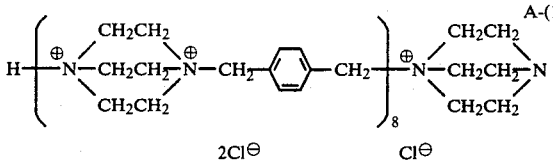

A-(2)

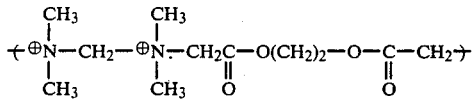

A-(3)

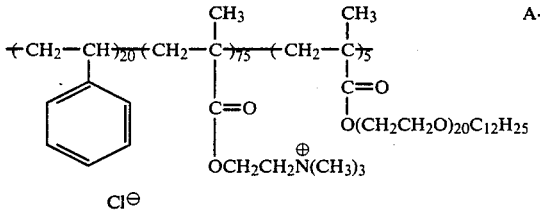

A-(4)

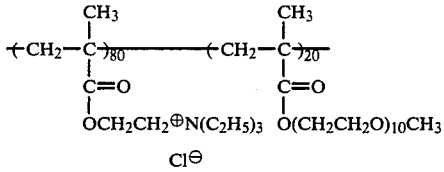

A-(5)

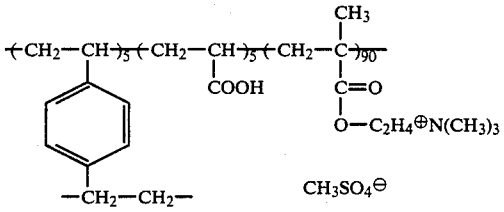

A-(6)

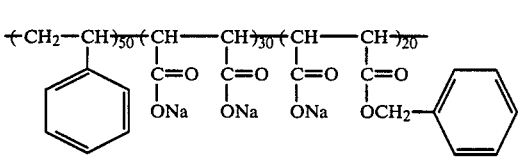

-continued

A-(7)

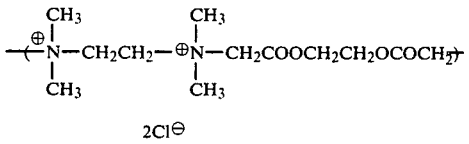

A-(8)

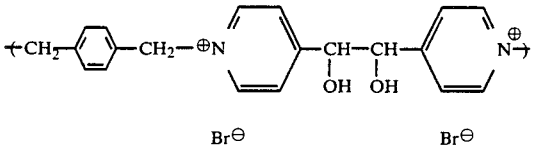

A-(9)

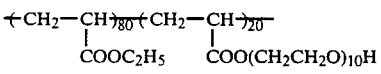

A-(10)

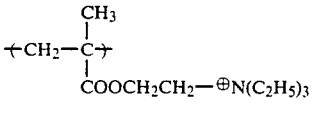

A-(11)

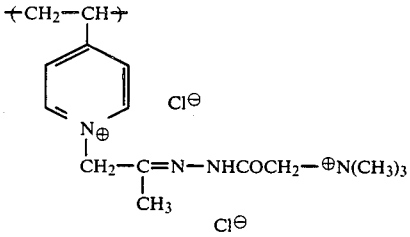

A-(12)

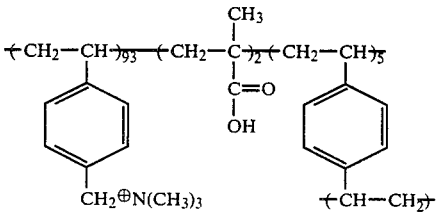

A-(13)

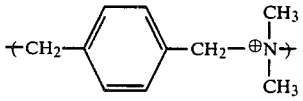

A-(14)

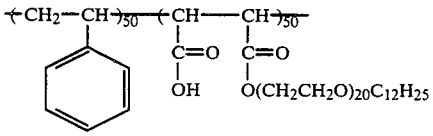

More preferred examples of the antistatic agents for use in this invention include A-(1), A-(2), A-(3), A-(5), A-(12) and A-(13).

At the practice of this invention, the silicone graft copolymer and the antistatic agent for use in this invention are previously added to the coating solution(s) for forming the surface layer(s) of the silver halide photographic light-sensitive material of this invention as a solution of them in water, an organic solvent such as methanol, ethanol, acetone, etc., or a mixture of them, or as an aqueous dispersion or an organic solvent dispersion of them prepared in the presence of a proper dispersing agent such as a surface active agent, etc., and the coating solution or dispersion is coated on the silver halide photographic emulsion layer formed on a support or on the back surface of the support of the photographic light-sensitive material, or after forming the layer for constituting the photographic light-sensitive material formed on a support or forming a back layer on the support, the surface layer or the back layer may be impregnated with the coating solution or dispersion following by drying.

When the antistatic agent is applied to a layer adjacent to the surface layer of the photographic light-sensitive material, the antistatic agent may be added to the coating solution for forming the adjacent layer by the same manner as described above.

In this invention, it is particularly effective and preferred to apply this invention to the back layer of the photographic light-sensitive material of this invention. The particularly preferred embodiment of this invention is a photographic light-sensitive material having a back layer formed by coating an antistatic layer on the support thereof and by further forming thereon a layer containing the silicone graft copolymer.

There are no particular restrictions on the amounts of the silicone graft polymer or copolymer and the antistatic agent for use in this invention and depend upon the kind and form of the photographic light-sensitive material, the coating system for producing the photographic light-sensitive material, etc., but the amount of the silicone graft polymer or copolymer is preferably 0.001 to 1.0 g, particularly 0.005 to 0.5 g per square meter of the photographic light-sensitive material. Also, the amount of the antistatic agent is 0.01 to 1.0 g, particularly 0.03 to 0.4 g per square meter of the photographic light-sensitive material.

As the binder having a film forming faculty, which is used at the practice of the silicone graft polymer or copolymer and the antistatic agent for use in this invention to the back layer of the photographic light-sensitive material of this invention, there are cellulose esters such as cellulose triacetate, cellulose diacetate, cellulose acetate malate, cellulose acetate phthalate, hydroxyalkyl alkylcellulose phthalate, etc.; polycondensated polymers such as the polycondensation product of formaldehyde and cresol, salicylic acid, or oxyphenylacetic acid and the polycondensation product of terephthalic acid or isophthalic acid and polyalkylene glycol; synthetic polymers, for example, a homopolymer of acrylic acid, methacrylic acid, styrenecarboxylic acid or styrenesulfonic acid, a copolymer of the foregoing monomer or maleic anhydride and a styrene derivative, an alkyl acrylate, an alkyl methacrylate, vinyl chloride vinyl acetate, an alkylvinyl ether, or acrylonitrile, the ring closed half esters or the half amides of maleic anhydride copolymers, partially hydrolyzed polyvinyl acetate, and the homopolymer or copolymer obtained from the monomer having a polymerizable unsaturated bond, such as polyvinyl alcohol, etc.

In the case of using the binder, water, organic solvents or a mixture of them can be used as the solvent.

The organic solvent which can be used in this invention as described above includes alcohols such as methanol, ethanol, butanol, etc.; ketones such as acetone, methyl ethyl ketone, etc.; halogenated hydrocarbons such as methylene chloride, carbon tetrachloride; ethers such as diethyl ether, dioxane, tetrahydrofuran, etc.; and aromatic hydrocarbons such as benzene, toluene, xylene, etc.

When the compounds (the silicone graft polymer or copolymer and the antistatic agent) for use in this invention are applied to a back surface of the support for the photographic light-sensitive material together with the above described binder, the proportions of these compounds each is about 1 to 300% by weight, preferably 2 to 150% by weight, to the amount of the binder.

When the compounds (the silicone graft polymer or copolymer and the antistatic agent) for use in this invention are applied to the back surface of a support of the photographic light-sensitive matefial of this invention, the amounts of these compounds each is 0.01 to 1 g, preferably 0.05 to 0.5 g, per square meter of the support.

The silicone graft polymer or copolymer for use in this invention can improve the physical properties of a photographic light-sensitive material, such as lubricity, scratch resistance, etc., without giving bad influences (the formation of fog, desensitization, etc.) on the photographic properties of the photographic light-sensitive material.

The particularly important advantage of this invention is that while in the case of applying a conventional organosilicone which is known as a photographic lubricant to a back layer of a photographic light-sensitive material, the occurrence of coating troubles becomes severe at the production of a photographic light-sensitive material, in the case of applying the silicone graft polymer or copolymer and the antistatic agent for use in this invention, there are neither the occurrence of coating troubles at coating silver halide photographic emulsions nor the formation of static troubles by the accumulation of electrostatic charges. Moreover, the features of this invention are also that the photographic light-sensitive material does not cause scum in processing solutions and have excellent antistatic property and lubricity and the deterioration of these properties is less.

The above described features and advantages of this invention are particularly important in the case of producing various photographic light sensitive materials for quick processing, the emulsion layer surface of which is not scratched even when the photographic light-sensitive material is subjected to severe processing by an automatic photographic processor under the conditions of a high pH, a high temperature and a high speed or the production of a cine positive photographic light-sensitive material requiring a high mechanical strength of the surface layer capable of enduring the repeating projection thereof.

The photographic light-sensitive material of this invention to which the above described silicone graft copolymer and the antistatic agent are applied has proper necessary lubricity and does not cause troubles by static charges or shows improved adaptability of a cine photographic film under the using conditions in a photographing machine or a projector.

Since the cine film to which this invention is applied shows good lubricity and sticking resistance in a projector, the cine film has such advantages that the film drives very smoothly and the noise of the film during driving is greatly reduced. Also, according to the sort of a projector, the driving cine film is brought into contact with parts of the projector at too sharp or strong pressure, whereby the photographic emulsion layer(s) are partially scraped off to form, sometimes, dust or film waste in the projector. However, the cine film of this invention is not accompanied with such a trouble. These advantages of this invention is considered to be based on the above described features of the silicone graft polymer or copolymer for use in this invention.

As the support for the photographic light-sensitive material of this invention, all the supports which are used for ordinary photographic light-sensitive materials can be used. For example, there are cellulose acetate films, cellulose acetate butyrate films, polystyrene films, polyethylene terephthalate films, the laminates of these films, papers, etc. Furthermore, baryta-coated films and papers coated or laminated with a polymer of an α-olefin having 2 to 10 carbon atoms, such as polyethylene, polypropylene, etc., can be used as the support.

For the photographic light-sensitive materials of this invention, various hydrophilic colloids are used as the binders. That is, as the hydrophilic colloid which is used as binders for silver halide photographic emulsion layers and/or other layers for constituting the photographic light-sensitive material, there are, for example, gelatin, colloidal albumin, casein, cellulose derivatives (e.g., carboxymethyl cellulose, hydroxyethyl cellulose, etc.), sugar derivatives (e.g., agar agar, sodium alginate, starch derivatives, etc.), synthetic derivatives (e.g., polyvinyl alcohol, poly-N-vinylpyrrolidone, and the derivatives or partially hydrolyzed products of them), etc. If desired, a compatible mixture of at least two of these colloids can be used. Among these substances, gelatin is most generally used.

The silver halide photographic emulsion layers and other photographic layers of the photographic light-sensitive materials of this invention may further contain a synthetic polymer compound such as a latex form water dispersed vinyl polymer, in particular, a compound capable of improving the dimensional stability of the photographic light-sensitive material solely or as a mixture thereof with other similar synthetic polymer compound or as a combination of the synthetic polymer and a hydrophilic water-permeable colloid.

The photographic emulsion layers and/or other photographic layers of the photographic light-sensitive materials can be hardened according to a conventional manner or by using conventional hardening agents. Examples of the hardening agent are aldehyde compounds such as formaldehyde, glutaraldehyde, etc.; ketones such as diacetyl, cyclopentanedione, etc.; bis(2-chloroethylurea), 2-hydroxy-4,6-dichloro-1,3,5-triazine, etc. Other examples of the hardening agent are the compounds having reactive halogen, divinylsulfone, 5-acetyl-1,3-diacryloyl-hexahydro-1,3,5-triazine, etc., as described in U.S. Pat. Nos. 3,288,775, 2,732,303, British Pat. Nos. 974,723, 1,167,207, etc., the compounds having reactive olefin, N-hydroxymethyl phthalimide, etc., as described in U.S. Pat. Nos. 3,635,718, 3,232,763, 3,490,911, 3,642,486, British Pat. No. 994,869, the N-methylol compounds as described in U.S. Pat. Nos. 2,732,316, 2,586,168, etc., the isocyanates as described in U.S. Pat. No. 3,103,437, etc.; the aziridine compounds as described in U.S. Pat. Nos. 3,017,280, 2,983,611, etc., the acid derivatives as described in U.S. Pat. Nos. 2,725,294, 2,725,295, etc., the carbodiimido compounds as described in U.S. Pat. No. 3,100,704, etc., the epoxy compounds as described in U.S. Pat. No. 3,091,537, etc., the isooxazole compounds as described in U.S. Pat. Nos. 3,321,313, 3,543,292, etc.; halogenocarboxyaldehydes such as mucochloric acid, etc.; dioxane derivatives such as dihydroxydioxane, dichlorodioxane, etc.; and inorganic hardening agents such as chromium alum, zirconium sulfate, etc.

In place of the above described compounds, precursors for these compounds, such as alkali metal bisulfite-aldehyde addition products, methylol derivatives of hydantoin, primary aliphatic nitro alcohols, etc., can be used.

The silver halide emulsion for use in this invention is prepared by mixing an aqueous solution of a water-soluble silver salt (e.g., silver nitrate) and an aqueous solution of a water-soluble halide (e.g., potassium bromide) in the presence of an aqueous solution of a water-soluble polymer such as gelatin. As the silver halide for the silver halide emulsion, silver chloride and silver bromide as well as a mixed silver halide such as silver chlorobromide, silver iodobromide, silver chloroiodobromide, etc., can be used in this invention.

In the production step of the photographic light-sensitive materials, various compounds can be added to the above described silver halide photographic emulsions for preventing the occurrence of the reduction in sensitivity and the formation of fog during the storage or processing of the photographic light-sensitive materials. Examples of these compounds are 4-hydroxy-6-methyl-1,3,3a,7-tetraazaindene, 3-methylbenzothiazole, 1-phenyl-5-mercaptotetrazole, etc., as well as many heterocyclic compounds, mercury-containing compounds, mercapto compounds, metal salts, etc.

The silver halide photographic emulsions for use in this invention can be chemically sensitized by an ordinary manner. As chemical sensitizers which are used for the purpose, there are metal compounds such as chloroaurates, gold trichloride, etc., salts of noble metals such as platinum, palladium, iridium, rhodium, luthenium, etc.; sulfur compounds capable of forming silver sulfide by causing reaction with a silver salt; stannous salts; amines; and other reducing substances.

The silver halide photographic emulsions for use in this invention may be, if necessary, subjected to a spectral sensitization or a supersensitization using cyanine dyes such as cyanine, merocyanine, carbocyanine, etc., solely or as a combination of them, or as a combination thereof with styryl dyes, etc.

The photographic light-sensitive materials of this invention may further contain, in the light-insensitive layers for constituting the photographic light-sensitive material, stilbene, triazine, oxazole, or a cumarine series compounds as a whitening agent; benzotriazole, thiazolidine, a cinnamic acid ester compound, etc., as an ultraviolet absorbent; known various photographic filter dyes as light absorbents; the water-insoluble materials described in British Pat. Nos. 1,320,564, 1,320,565, U.S. Pat. No. 3,121,060, etc., as a sticking preventing agent; and the surface active agent as described in U.S. Pat. No. 3,617,286. Also, the photographic light-sensitive materials may contain inorganic compounds having a suitable particle size, such as silver halide, silica, strontium barium sulfate, etc., or polymer latexes such as polymethyl methacrylate, etc.

The silver halide photographic emulsions for use in this invention include various photographic emulsions such as orthochromatic silver halide emulsions, panchromatic silver halide emulsions, infrared silver halide emulsions, X-ray or invisible ray recording silver halide emulsion, color photographic silver halide emulsions such as silver halide emulsions containing dye forming couplers, silver halide emulsions containing dye developing agents, silver halide emulsions containing bleachable dyes, etc.

The color photographic silver halide emulsions for use in this invention may contain 2-equivalent or 4-equivalent dye forming couplers. For example, open chain type ketomethylene yellow forming couplers such as benzoylacetanilide series couplers and pivaloylacetanilide series couplers; magenta forming couplers such as pyrazolone series couplers and indazolone sereis couplers; and cyan forming couplers such as phenolic couplers and naphtholic couplers can be preferably used. Specific examples of these dye forming couplers which are used for the photographic light-sensitive materials of this invention are the yellow couplers shown by general formula (I) described in Japanese Patent Publication No. 18256/73 (corresponding to U.S. Pat. No. 3,640,716); the magenta couplers described in Japanese Patent Application No. 56670/69 (corresponding to U.S. Pat. No. 3,706,556); the cyan couplers described in Japanese Patent Application No. 76515/71 (corresponding to U.S. Pat. No. 3,844,784); the colored couplers described in U.S. Pat. Nos. 2,428,054, 2,449,966, 2,455,170, 2,600,788, 2,983,608, 3,148,062, etc.; and the release inhibition type couplers described in U.S. Pat. No. 3,227,554.

The following examples are intended to illustrate the present invention but not to limit the invention in any way.

EXAMPLE

The following antistatic agent (A) was used in this example:

Antistatic Agent (A):

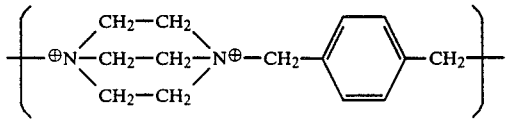

$2Cl^{\ominus}$

Viscosity No.*: 0.12

Molecular Weight: 25,000

*: The viscosity No. is the value measured on an aqueous 1% sodium chloride solution having a concentration of 0.1% at 30° C.

In 10 ml of water was dissolved 4 g of the antistatic agent and the solution was diluted by a mixed solvent of 600 ml of methanol and 400 ml of acetone. The solution thus obtained was coated on a cellulose acetate film at a coverage of 50 mg/m$^2$ and dried.

Then, the coating solution having the composition shown in Table 1 was coated on the layer and dried to form a back layer.

TABLE 1

Coating Composition of Back Surface Layer

| | Sample No. | | | | |
|---|---|---|---|---|---|
| Composition | A-I (parts) | A-II (parts) | A-III (parts) | A-IV (parts) | A-V (parts) |
| Diacetyl Cellulose | 5 | 5 | 5 | 5 | 5 |
| Acetone | 700 | 700 | 700 | 700 | 700 |
| Methanol | 300 | 300 | 300 | 300 | 300 |
| Compound (3)* | 0.1 | — | — | — | — |
| Compound (5)** | — | 0.1 | — | — | — |
| Comparison Compound-1 | — | — | 0.1 | — | — |
| Comparison | — | — | — | 0.1 | — |

TABLE 1-continued

| Coating Composition of Back Surface Layer | | | | | |
|---|---|---|---|---|---|
| | Sample No. | | | | |
| Composition | A-I (parts) | A-II (parts) | A-III (parts) | A-IV (parts) | A-V (parts) |
| Compound-2 | | | | | |

*Silicone graft polymer of this invention (amount of silicone unit component)
**Silicone graft polymer of this invention (amount of silicone unit component)

Comparison Compound-1:

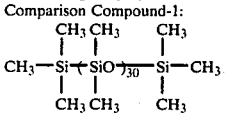

Comparison Compound-2:

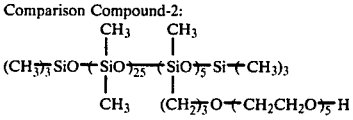

On the opposite surface of each of the five supports having the back surface was formed a subbing layer and then an antihalation layer, a red-sensitive silver halide emulsion layer, a gelatin interlayer, a green-sensitive silver halide emulsion layer, a yellow filter layer, a blue-sensitive silver halide emulsion layer, and a protective layer were coated, in succession, thereon to provide each of the cine color negative photographic film samples A-I, A-II, A-III, A-IV and A-V. For each of the above described red-sensitive silver halide emulsion and green-sensitive silver halide emulsion, a silver iodobromide emulsion containing 6 mol % iodine was used. For the blue-sensitive silver halide emulsion, a silver iodobromide emulsion containing 8 mol % iodine was used.

Each of these sample films was stored for 1 week at 25° C. and 60% RH and then cut into a web of 400 feet in length and 35 mm in width.

Each of the test films was subjected to the following performance tests.

The items of the performance tests are (1) a coating aptitude of the coating solution of the photographic layer for a support, (2) the antistatic performance, (3) the measurement of the attaching amount of dust onto the film after processing and the electrostatic friction coefficient, (4) the measurement of the resistance at the case of pulling out the film through an aperture plate and a pressure plate of a camera (corresponding to the traveling property in camera at photographing), (5) the formation amount of scum in processing solution, and (6) photographic properties.

(1) Coating aptitude for support of a coating solution for photographic layer

A subbing layer was formed on the opposite surface of a support having the base back layer and then a coating solution for an antihalation layer, a coating solution for a red-sensitive silver halide emulsion layer and further a coating solution for a gelatin interlayer were coated on the subbing layer at a traveling speed of the support of 800 meters/min. and the coated layers were dried at a dry bulb temperature of 35° C. and a wet bulb temperature of 18° C. to provide an intermediate product for a cine color negative photographic film. Then, the surface of the intermediate product thus obtained was observed by the naked eye with reflected light.

Evaluation:

No formation of uneven coating: o

Very weak formation of uneven coating: Δ

Uneven coating formed: x

Uneven coating formed greatly: xx (2) Evaluation method of antistatic faculty

The antistatic faculty was evaluated by measurement of the surface resistibility and the formation of static marks.

(i) The surface resistibility was evaluated by inserting a test piece of each sample film between brass electrodes (stainless steel was used for the portions thereof which were brought into contact with the test piece) of a length of 10 cm and with an interval of electrodes of 0.14 cm, and measuring the 1 minute value by means of an insulation tester TR 8651, made by Takeda Riken K.K.

(ii) The test for the static mark formation was performed by a method of forming static marks by contacting the antistatic agent-containing surface of a sample of the unexposed photographic light-sensitive material with a rubber sheet under pressure and then peeling off the sample.

The measurement of the surface resistibility was performed at 25° C. and 30% RH and the test for the static mark formation was performed at 25° C. and 30% RH. In addition, the humidification of the test piece of the sample was performed for a whole day and night under the foregoing conditions.

For evaluating the extent of the formation of static marks, each sample was subjected to the development process as will be described below.

(3) Attached amount of dust on the film after development

The amount of dust attached on the surface of a sample film when the sample film was passed through an automatic printer (printer speed of 15,000 sheets/hr) was evaluated by observing the amount of white spots on the surface of the printed film (or photographic paper) by the naked eye. The evaluation was made according to the following three grades.

A: Attachment of dust is not observed.

B: Attachement of dust is observed a little.

C: Attachment of dust is observed considerably.

(4) Measurement method of electrostatic friction coefficient

The maximum electrostatic friction coefficient on the film back surface was measured by the paper clip method described in T. Anvelt, J. F. Carroll, Jr., and L. J. Sugden, *J. SMPTE*, 80 (9), 734–739 (1971).

(5) Measurement of pulling out resistance

An aperture plate and a pressure plate of a camera (Apriflex 35IIA, made by Arnold & Richter Co.) were placed on a movable table, a sample was inserted between the aperture plate and the pressure plate, and after fixing one end of the sample to a load cell, the movable table was moved at 10 meters/min, whereby the maximum friction resistance of the film occurred in this case was measured.

(6) Amount of the formation of scum in processing solution

After continuously processing each film sample of 0.5 $m^2$ in area by the following processing steps, the state of the formation of scum on the surface of the film sample was observed by the naked eye. The evaluation was made according to the following three stages:

A: Formation of scum is not observed.
B: Formation of scum is observed a little.
C: Formation of scum is observed considerably.

| Processing Step | Temperature (°C.) | Time |
|---|---|---|
| Color Development | 41 | 3 min |
| Stop | 38 | 30 sec |
| Wash | " | 30 sec |
| Prebath | " | 30 sec |
| Bleach | " | 3 min |
| Wash | " | 1 min |
| Fix | " | 2 min |
| Wash | " | 2 min |
| Stabilization | " | 10 sec |

The processing solutions used in the above processing steps had the following compositions.

| | |
|---|---|
| Color Developer: | |
| Sodium Hydroxide | 2 g |
| Sodium Sulfite | 2 g |
| Potassium Bromide | 1.4 g |
| Sodium Chloride | 1 g |
| Borax | 1 g |
| Hydroxylamine Sulfate | 4 g |
| Disodium Ethylenediaminetetraacetate | 2 g |
| 4-Amino-3-methyl-N—ethyl-N—(β-hydroxyethyl)aniline Monosulfate | 4 g |
| Water to make | 1 liter |
| Stabilization Bath: | |
| Formaldehyde (37%) | 10 ml |
| Water | 1 liter |

The results thus obtained are shown in Table 2.

TABLE 2

| Sample No. | Coating Aptitude | Surface Resistibility Before Processing (Ω) | Surface Resistibility After Processing (Ω) | Attached Amount of Dust on Processed Film | Friction Coefficient Before Processing (μ) | Friction Coefficient After Processing (μ) | Pulling Out Resistance Before Processing (g) | Pulling Out Resistance After Processing (g) | Amount of Scum Formation |
|---|---|---|---|---|---|---|---|---|---|
| A - I (Invention) | o | $5.5 \times 10^9$ | $6.0 \times 10^{12}$ | A | 0.19 | 0.20 | 484 | 480 | A |
| A - II (Invention) | o | $7.8 \times 10^9$ | $5.0 \times 10^{12}$ | A | 0.20 | 0.20 | 481 | 478 | A |
| A - III (Comparison Example) | xx | $6.1 \times 10^{10}$ | $>10^{15}$ | B | 0.21 | 0.28 | 485 | 640 | B~C |
| A - IV (Comparison Example) | xx | $2.3 \times 10^{10}$ | $>10^{15}$ | B | 0.21 | 0.26 | 481 | 630 | B~C |
| A - V (Control) | o | $5.1 \times 10^9$ | $>10^{15}$ | B | 0.47 | 0.48 | 908 | 910 | C |

As is clear from the results shown in Table 2, in the samples (A-I and A-II) of this invention using the silicone graft copolymer and the antistatic agent, coating troubles are not occurred, the antistatic faculty of the antistatic agent used is not reduced, and the deterioration of the antistatic faculty thereof after processing is less, whereby the attachment of dust on the surface of the film does not occur.

Also, the samples of this invention have excellent lubricity (coefficient of friction, and pulling out resistance) and almost no reduction thereof is observed even after processing. Further, the formation of scum in the processing solution does not occur.

On the other hand, in the comparison samples (A-III and A-IV), coating troubles occur considerably, the antistatic property and lubricity are greatly reduced after processing, and a considerable formation of scum is observed.

The photographic properties (sensitivity, fog, etc.) are in a level of causing no trouble in both cases.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive element comprising:

(a) a support having thereon at least one silver halide photographic light-sensitive emulsion layer;

(b) at least one light-insensitive surface layer on at least one side of said support, said surface layer comprising:

(i) a graft polymer having a component which comprises a silicone unit and a component having an affinity with a polymer used as a binder within said light-sensitive element, wherein the amount of said graft polymer is 0.001 to 1.0 g. per square meter of said photographic light-sensitive element, and wherein said silicone unit (graft component silicone) is represented by general formula (I):

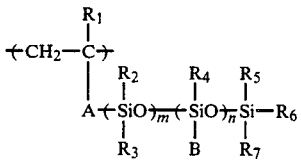

(I)

wherein $R_1$ represents a hydrogen atom or a methyl group; $R_2$, $R_3$, $R_4$, $R_5$, $R_6$ and $R_7$, which may be the same or different, each represents an alkyl group, a substituted alkyl group, an aryl group, a substituted aryl group, or a cycloalkyl group, each having 1 to 20 carbon atoms; m is 0 or an integer of 1 to 400; n is 0 or an integer of 1 to 50; said m+n being 0 to 450; when m and n are 0, said $R_5$, $R_6$ and $R_7$ each represents

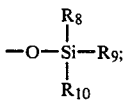

$R_8$, $R_9$ and $R_{10}$ have the same meaning as aforesaid $R_2$, $R_3$ and $R_4$; A represents a divalent group; and B represents a substituted alkyl group; and (c) at least one light-insensitive surface layer on at least one side of said support or a layer adjacent to a surface layer comprising an antistatic agent, wherein the amount of said antistatic agent is 0.1 to 1.0 g per square meter of said photographic light-sensitive element.

2. The silver halide photographic light-sensitive element as claimed in claim 1, wherein said antistatic agent is the polymeric compound having a monomer unit represented by the following general formula (II) or (III):

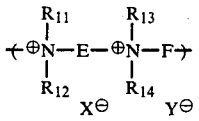

(II)

wherein $R_{11}$, $R_{12}$, $R_{13}$ and $R_{14}$ each represents a lower alkyl group having 1 to 4 carbon atoms; E and F each represents a divalent linkage group; said $R_{11}$, E and $R_{13}$ or said $R_{11}$, E and $R_{13}$ and said $R_{12}$, E and $R_{14}$ may form a ring; also, said $R_{11}$ and $R_{13}$, said $R_{12}$ and $R_{14}$, or said E and F may be the same or different; and $X^{\ominus}$ and $Y^{\ominus}$ each represents an anion;

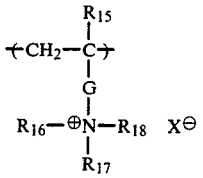

(III)

wherein $R_{15}$ represents a hydrogen atom or an alkyl group having 1 to 4 carbon atoms; G represents a divalent linkage group; $R_{16}$, $R_{17}$ and $R_{18}$ each represents an alkyl group, a substituted alkyl group, or a cycloalkyl group, each having 1 to 8 carbon atoms; said $R_{16}$ and $R_{17}$ may form a ring; $X^{\ominus}$ has the same meaning as described above.

3. The silver halide photographic light-sensitive element as claimed in claim 1, wherein the amount of said graft polymer having a silicone unit is 0.005 to 0.5 g per square meter of the photographic light-sensitive element.

4. The silver halide photographic light-sensitive element as claimed in claim 1, wherein the amount of said antistatic agent is 0.03 to 0.4 g per square meter of the photographic light-sensitive element.

5. The silver halide photographic light-sensitive element as claimed in claim 1, wherein said surface layer is a back layer of the photographic light-sensitive element.

6. The silver halide photographic light-sensitive element as claimed in claim 1, wherein the antistatic agent exists in a layer formed on a support at the back side and the graft polymer having the silicone unit exists in a back layer formed on the antistatic agent-containing layer.

* * * * *